US007958754B2

(12) United States Patent
Lonati

(10) Patent No.: US 7,958,754 B2
(45) Date of Patent: Jun. 14, 2011

(54) WARP-KNITTING MACHINE

(75) Inventor: Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 203 days.

(21) Appl. No.: 12/418,121

(22) Filed: Apr. 3, 2009

(65) Prior Publication Data

US 2009/0301140 A1 Dec. 10, 2009

(30) Foreign Application Priority Data

Jun. 4, 2008 (IT) ..... BS2008A0116

(51) Int. Cl.
*D04B 27/10* (2006.01)

(52) U.S. Cl. ..... 66/205; 66/207

(58) Field of Classification Search ..... 66/207, 66/204, 203, 205, 206
See application file for complete search history.

(56) References Cited

U.S. PATENT DOCUMENTS

| | | | | |
|---|---|---|---|---|
| 2,389,154 | A | 11/1945 | Kellogg et al. | |
| 4,761,973 | A | 8/1988 | Gangi | |
| 5,246,039 | A | 9/1993 | Fredriksson | |
| 5,285,821 | A | 2/1994 | Fredriksson | |
| 5,307,648 | A * | 5/1994 | Forkert et al. | 66/207 |
| 5,855,126 | A | 1/1999 | Otobe et al. | |
| 6,050,111 | A * | 4/2000 | Nosaka et al. | 66/207 |
| 2007/0033969 | A1 | 2/2007 | Mele et al. | |

FOREIGN PATENT DOCUMENTS

| | | | |
|---|---|---|---|
| CN | 1948580 | A | 4/2007 |
| DE | 452 277 | C | 11/1927 |
| WO | 90/09625 | A1 | 8/1990 |

OTHER PUBLICATIONS

English translation of Chinese Office Action issued in Chinese patent application No. 200910133399.X, which corresponds to U.S. Appl. No. 12/418,121, Nov. 8, 2010, p. 1-3.

"Structures and Products of New High-Speed Warp-Knitting Machine", Textile Industry Publishing Company, Jan. 1991, pp. 83-84.

* cited by examiner

*Primary Examiner* — Danny Worrell
(74) *Attorney, Agent, or Firm* — Pearne & Gordon LLP

(57) ABSTRACT

A warp-knitting machine (1) comprising a unitary supporting structure (2), at least one needle bed (3) mounted on the unitary supporting structure (2), at least one thread-guide bar (4) for feeding yarn to the needle bed (3), mounted on the unitary supporting structure (2), a yarn feeding device (5) to the thread-guide bar (4) and to the needle bed (3); and electric and electronic devices (6) for the operation of the warp-knitting machine (1), the electric and electronic devices comprising at least main electronic devices (8) for the operation of the warp-knitting machine (1), the main electronic devices (8) comprising at least the power electronic devices and/or the servodrives for piloting the motors of the machine (1) and being mounted on the unitary supporting structure (2).

20 Claims, 5 Drawing Sheets

WARP-KNITTING MACHINE

The present invention relates to a warp-knitting machine, i.e. a linear knitting machine commonly referred to as warp, raschel or tricot loom and normally used in the manufacture of textile articles of various types.

Known warp-knitting machines, two typical examples of which are disclosed in U.S. Pat. No. 4,761,973 and U.S. Pat. No. 5,855,126, are made up of a unitary supporting structure in which all the mechanical components for the performance of the knitting task of the machine are housed and mounted, such as for instance needle beds, thread-guide bars, mechanisms for needle bed and bar actuation, yarn feeding devices and devices for taking down the fabric produced by the machine.

Beyond such unitary supporting structure, known warp-knitting machines always include a second outer structure which is well separated from the first one, typically a control cabinet or panel, in which the most delicate electronic components of the machine are housed (in particular power electronics such as servodrives for piloting motors, and some processing units) and which is connected to the unitary supporting structure by means of a plurality of connecting cables.

Such configuration is due to a series of reasons, one of the main reasons being the need to prevent such delicate electronic parts from undergoing high vibrations as are typical of warp-knitting machines, due to the movement of huge masses at very high speeds.

As a matter of fact, it is well known that vibrations in warp-knitting machines are considerably high and would be extremely dangerous to delicate electronic components such as control and processing electronics of modern machines.

Known solutions as described above have some relevant drawbacks.

First of all, the presence of two separate structures results in a higher complexity of the machine, with higher costs for the construction of both structures, of the various connections required and of their interfaces.

Moreover, such configuration increases the installation complexity of the machine, requiring the connection of separate parts and increasing the risk of faults and damages during these operations.

Also transport costs for the machine and related risks are increased.

Furthermore, the global structure of the machine is very bulky and little rational, and the presence of delicate, expensive interfaces and of connections between the two structures is uncomfortable and involves higher risks of failures and damages to the machine during use.

The aim of the present invention is to solve the problems of the prior art by proposing a warp-knitting machine without the drawbacks mentioned above.

In particular, an aim of the present invention is to provide a warp-knitting machine with a compact and rational structure, which is little bulky and therefore easier to carry out, transport and install in a plant. As a consequence, an aim of the invention is to provide a warp-knitting machine having an integrated and modular structure, in which the various electronic parts can be easily accessed.

Still another aim of the invention is to propose a warp-knitting machine with a high reliability during operation.

Moreover, an aim of the invention is to present a warp-knitting machine which reduces the risk of faults during the mounting step of the machine and the risk of damages to the machine during use.

A final aim of the present invention is to carry out a warp-knitting machine which is easy to carry out and has short times and low costs for its implementation, transport and installation.

These and other aims, which shall be more evident from the following description, are achieved according to the present invention by a warp-knitting machine according to the appended claims.

Further characteristics and advantages shall appear better from the description of a preferred, though not exclusive embodiment of the invention, disclosed to an indicative purpose in the following figures.

Figure 1:
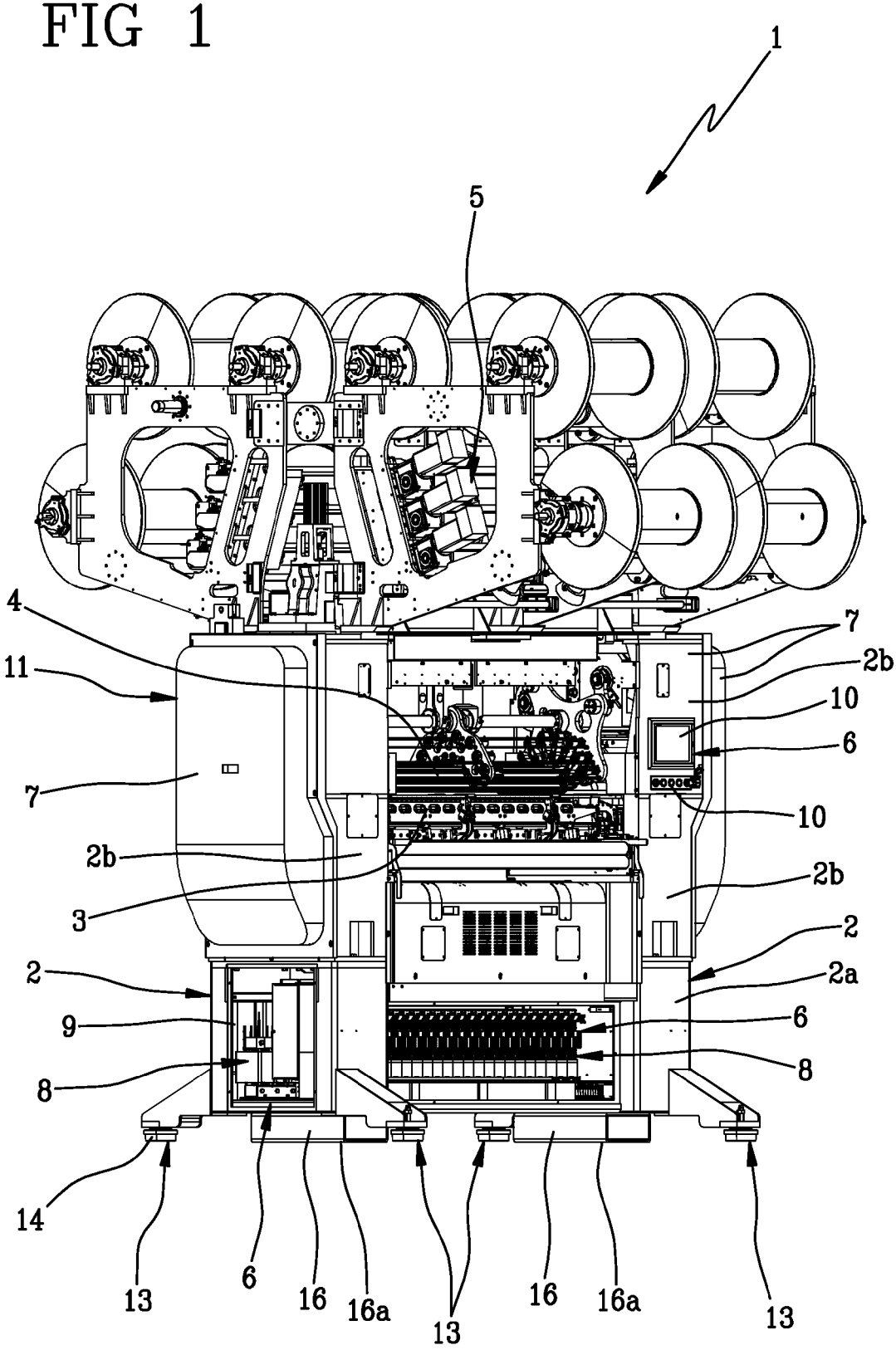
FIG. 1 shows a perspective view of a warp-knitting machine according to the present invention, some closing coves being removed.
Figure 2:
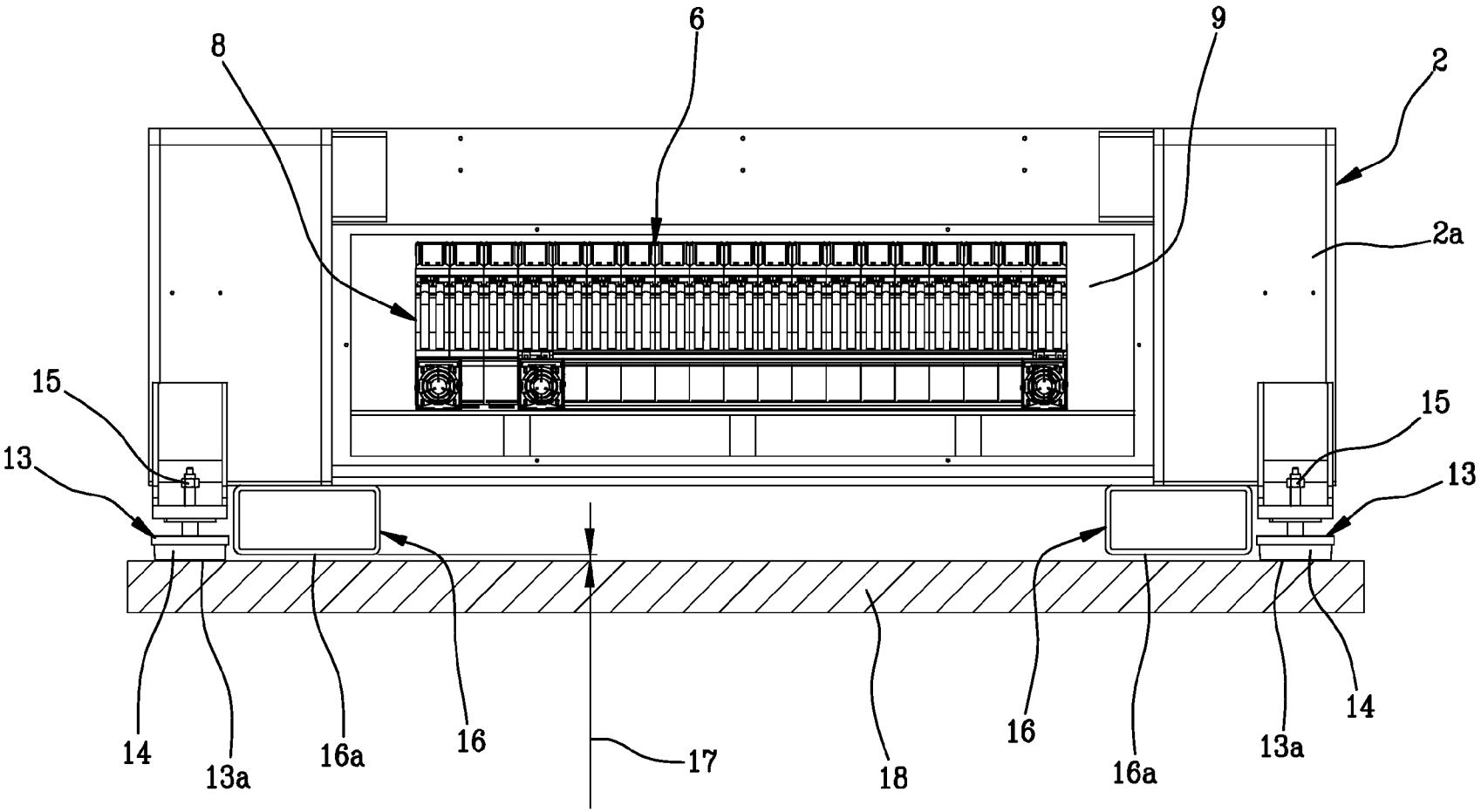
FIG. 2 shows a front view of a lower portion of the machine of FIG. 1.
Figure 3:
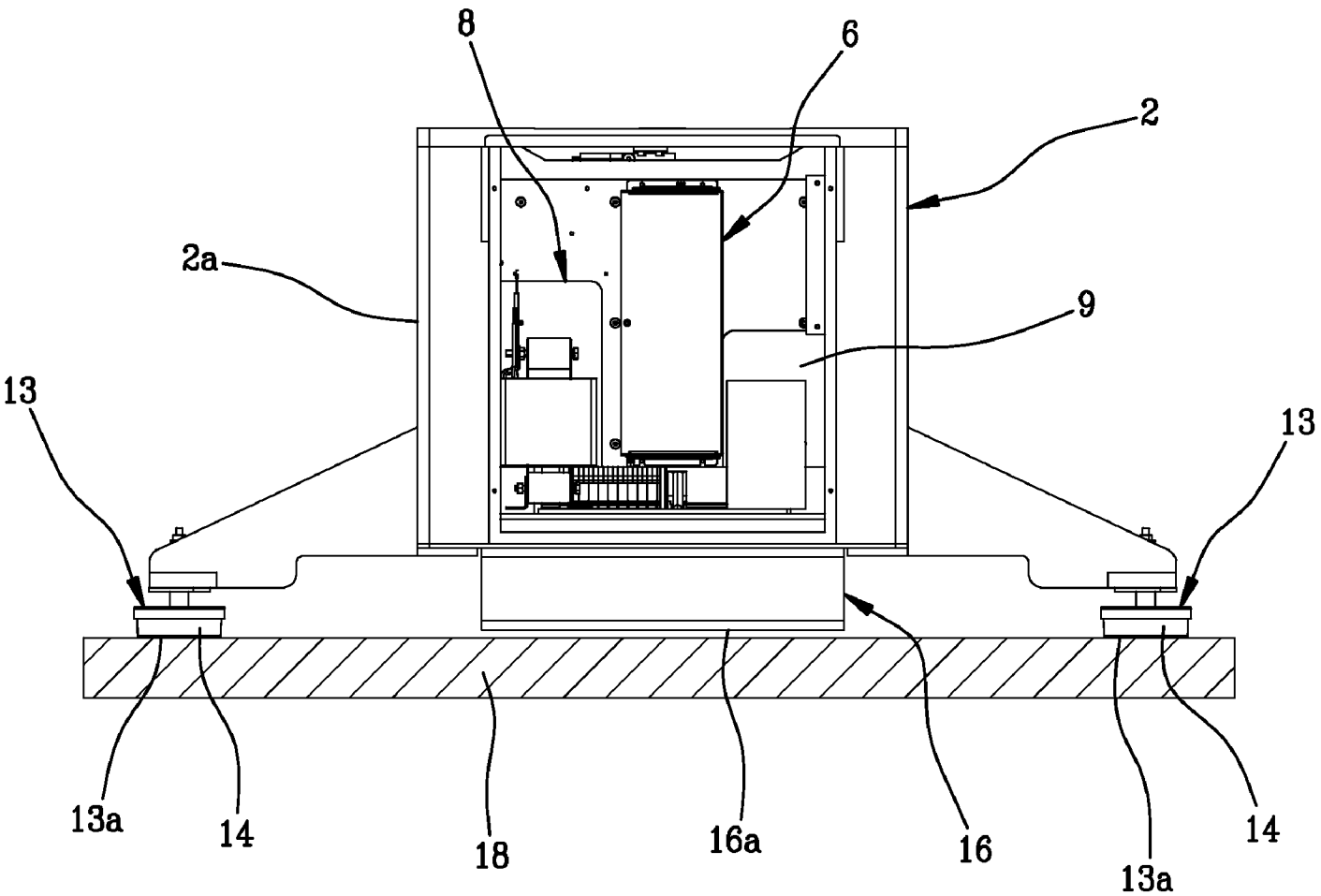
FIG. 3 shows a side view of a lower portion of the machine of FIG. 1.

With reference to the figures mentioned above, a warp-knitting machine 1 according to the invention comprises a unitary supporting structure 2. According to the invention, such unitary supporting structure 2 is a unique, independent structure and does not comprise a plurality of distinct and separate supporting structures, remotely connected by means of connecting cables for instance, and therefore does not include traditional cabinets separate from the main supporting structure. The unitary supporting structure 2 can be carried out also by means of more distinct structural parts, which are assembled and mutually integrated so as to build one global supporting structure, thus being a unique block.

In the present text the term "unitary supporting structure" means a set of supporting structural elements which are mutually mounted and connected in order to prop and/or house all the components of the warp-knitting machine 1 (thus also covers), and according to the present invention this set of structural elements makes up a unique block and not several separate blocks connected to one another by means of connecting cables outside said structure.

The warp-knitting machine 1 further comprises a plurality of per se conventional components mounted on the unitary supporting structure 2, such as at least one needle bed 3, and preferably at least two of these needle beds 3, at least one thread-guide bar 4 for feeding yarn to the needle bed 3, and preferably a plurality of thread-guide bars 4 of fixed or jacquard type, and a yarn feeding device 5 for feeding yarn to the thread-guide bar 4 and to the needle bed 3, which device in the example shown is mounted above the unitary supporting structure 2.

The machine 1 further comprises other conventional components, which are not described and disclosed in detail in the present description since they are absolutely conventional and implicit in the definition of warp-knitting machine 1, such as for instance a device for taking down the fabric produced by the needle beds, mechanisms for actuating the needle beds and the thread-guide bars, etc.

The machine 1 further comprises a plurality of electric and electronic devices 6, which are per se conventional and essential to the operation of the warp-knitting machine 1, e.g. for the electric connection of the various inner components of the machine 1, for the development of working programs for the machine 1 and for the control of the movement of all the components mentioned above.

According to the present invention, said electric and electronic devices 6 of the machine 1 are all mounted wholly to said unitary supporting structure 2 of the machine 1.

In the preferred embodiment, the electric and electronic devices 6 for the operation of the warp-knitting machine 1 are integrated, housed and mounted into the unitary supporting structure 2, and are therefore housed basically inside the unitary supporting structure 2 and the corresponding closing covers 7.

"Basically inside" includes in the present description also the case in which some single components, such as the user interface monitor and the programming keyboard, are mounted on the covering of the unitary supporting structure 2 of the machine 1.

The electric and electronic devices 6 of the machine 1 include some subsets of components, among which the main are:

1—The main electronic devices 8 for the operation of the warp-knitting machine 1. According to the present invention, the main electronic devices 8 comprise at least the power electronics and/or the servodrives for piloting the machine motors, which in the prior art were always arranged inside an outer cabinet separated from the unitary supporting structure 2. Preferably, this subset includes also the electronic components, sometimes referred to as master components, which process the operations the machine 1 and its components must execute, such as for instance conventional processing units and related components.

Preferably, these main electronic devices 8 can include at least part of the processing and control devices, i.e. CPUs or processors for the operation of the machine, and other electronic devices such as I/O devices, i.e. analogue and digital input/output devices for the connection to the remaining parts of the machine.

According to the present invention, the main electronic devices 8 are mounted on the unitary supporting structure 2, and preferably into the unitary supporting structure 2, and still more preferably inside at least one housing compartment 9 obtained on a lower portion 2*a* of the unitary supporting structure 2.

This housing compartment 9 is preferably arranged below the needle beds 3 and the thread-guide bars 4. These electronic components, which are more delicate than the others, are thus positioned in the portion of the machine 1 which is subject to less vibrations thanks to its height off the ground and the robustness of its structure.

Preferably, the main electronic devices 8 are mounted at a height of 20 to 100 cm off the ground, and anyhow advantageously preferably not below 20 cm.

2—The user interface electronic devices 10 are connected to the main electronic devices 8 for managing data input and output towards an operator of the machine 1. The user interface electronic devices 10 can include for instance a monitor, a keyboard, a plurality of control keys, and if necessary part of the processing units or CPUs, as well as the required connecting cables for data, power supply, etc.

The user interface electronic devices 10 are mounted on the unitary supporting structure 2 on a middle and/or side portion 2*b* of said unitary supporting structure 2, which is placed above and/or at a higher height than the lower portion 2*a*, for instance basically at the same height as the operating components such as needle beds 3 and thread-guide bars 4.

3—The secondary electronic devices 11 for controlling the mechanical parts of the warp-knitting machine 1, which are also referred to as slave electronic devices since they are "slaved", i.e. connected to and controlled by the main electronic devices 8. The secondary electronic devices 11 can include for instance the dedicated electronics of the motors and the electronics integrated into the structure of said motors, sensors, encoders, piezoelectric devices, analogue/digital converters, data or power supply connecting cables, etc.

These secondary electronic devices 11 are less delicate than the main electronic devices 8 and are preferably mounted on the unitary supporting structure 2 and inside said supporting structure on a middle and/or side portion 2*b* thereof, anyhow arranged above and/or at a higher height than the lower portion 2*a*.

4—The conventional electric devices for the connection of the various parts of the machine 1, such as for instance connecting cables, few of which can also extend outside the unitary supporting structure 2 of the machine 1, e.g. for the connection to the power supply network. All the electric devices for the connection of the inner parts of the machine, however, are preferably housed inside the unitary supporting structure.

According to the present invention, at least part of the electric and electronic devices 6 for the operation of the warp-knitting machine 1, and/or of the main electronic devices 8 for the operation of the warp-knitting machine 1 and/or of the secondary electronic devices 11 for the control of the mechanical parts of the warp-knitting machine 1, are mounted on the unitary supporting structure 2 by means of vibration damping elements 12, preferably of elastic type.

Figure 4:
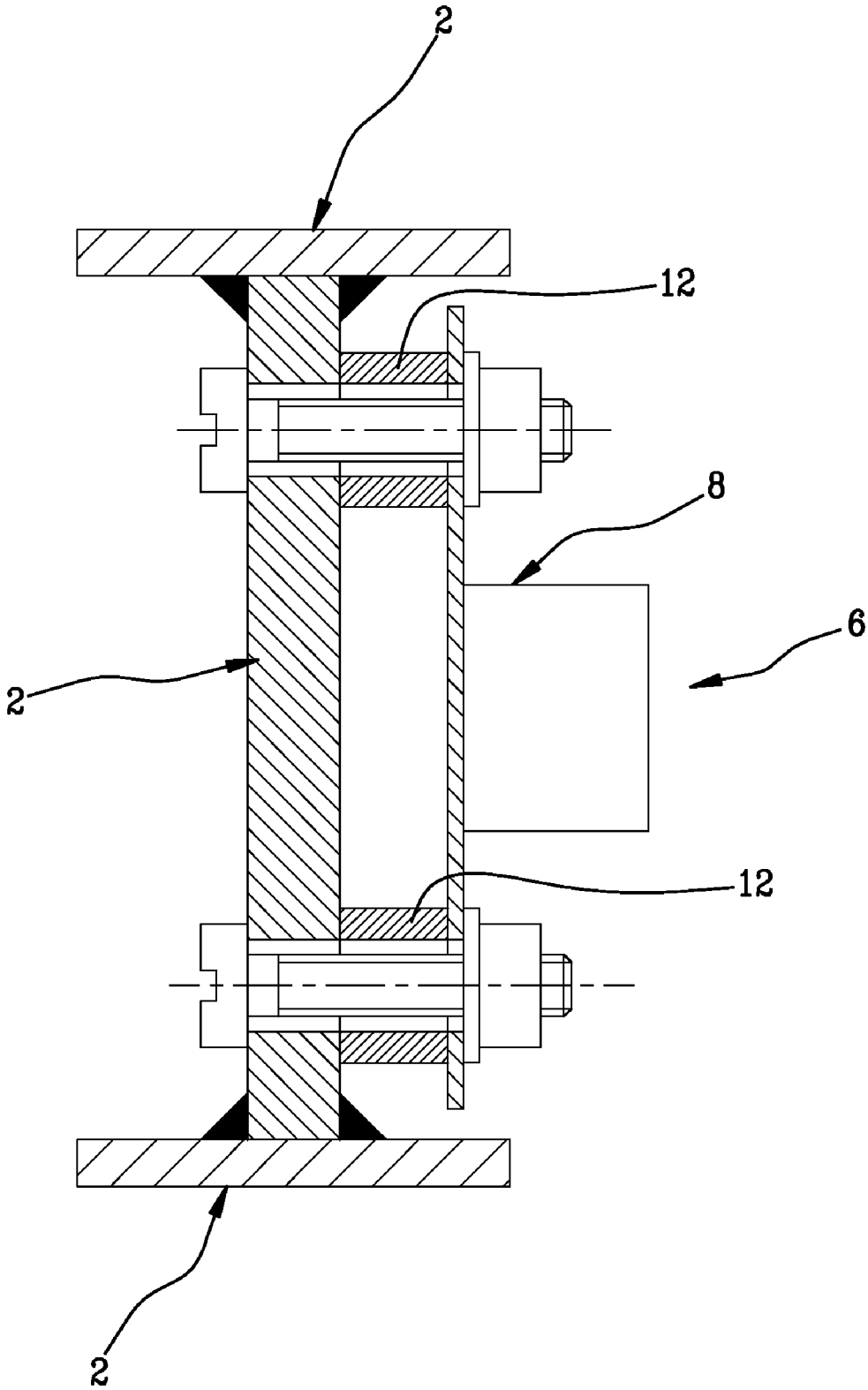
FIG. 4 shows a detail of an inner component of the machine of FIG. 1.

As can be seen in FIG. 4, in particular the main electronic devices 8 are mounted on the unitary supporting structure 2 of the machine 1 by means of vibration damping elements 12, preferably of elastic type, placed between the unitary supporting structure 2 and said main electronic devices 8, which elements 12 enable a further reduction of vibrations transmitted to the main electronic devices 8.

The vibration damping elements 12, and if necessary also the other damping elements of the machine, can be made of any suitable elastic damping material, e.g. VULCOLAN®.

This measure can be taken when mounting all the electric and electronic devices 6 referred to above in order to reduce the risks of failures thereof. According to the present invention, the warp-knitting machine 1 further comprises a plurality of feet 13 for resting onto the ground 18 apt to prop the unitary supporting structure 2 and therefore the machine 1, and in particular the disclosed embodiment includes four feet 13.

Advantageously, these resting feet 13 are provided with vibration damping devices 14, such as elastic elements apt to absorb and reduce the amount of vibrations in the machine 1.

Moreover, these feet 13 are preferably height adjustable so as to vary the height off the ground 18 of the unitary supporting structure 2 and of the warp-knitting machine 1, e.g. by means of a screw mechanism 15 of per se conventional type, which enables to lift and lower the machine 1 by turning a rotating element. According to the present invention, the warp-knitting machine 1 further comprises at least an additional damping element 16 mounted below the unitary supporting structure 2 and provided with a resting surface 16*a*.

A plurality of said additional damping elements 16 can be provided for, and in the disclosed embodiment two of them are arranged symmetrically on both sides of the machine 1.

The resting surface 16*a* is configured so as to be at a predefined distance 17 from the ground 18 with the machine 1 still, and so as to get in contact with the ground 18 during at least an operating condition of the machine 1 (i.e. at least a running state at a given operating speed), in order to damp the vibrations thereof.

In further detail, the resting surface 16*a* of the additional damping element 16 is configured so as to be, with the main 1 still, at a greater distance 17 from the resting surface 13*a* on the ground of the feet 13, and so as to lower at least up to the height of the resting surface 13*a* on the ground of the foot 13 or farther during at least an operating condition of the machine 1.

Thus, when the machine 1 is running, the residual vibrations make the additional damping element 16 touch the ground 18 (since the feet 13 are equipped with said vibration damping devices 14, e.g. of elastic type, which therefore enable a reduced vertical movement of the machine 1) and discharge the vibration energy to the ground 18 through the resting surface 16*a* of the additional damping element 16, thus damping and reducing the amount of said vibration.

The distance 17 between the resting surface 16*a* of the additional damping element 16 and the height of the resting surface 13*a* on the ground of the feet 13, with the machine 1 still, is smaller than the amplitude of the vibrations transmitted to said resting surface 16*a* during at least an operating condition of the warp-knitting machine 1, so that the resting surface 16*a* of the additional damping element 16 can touch the ground 18.

The distance between said resting surface 16*a* of the additional damping element 16 and the height of the resting surface 13*a* on the ground of said feet 13, with the machine 1 still, is preferably in the range of 1 to 5 mm, or in an alternative embodiment below 1 mm.

Advantageously, the height-adjustable feet 13 also allow to adjust the height 17 off the ground of the resting surface 16*a* of the additional damping element 16 according to the various needs and the specific appearance of the resting ground 18.

Preferably, the width and/or length of the resting surface 16*a* of the additional damping element 16 correspond at least to 50% of the width and/or length of the lower portion of the unitary supporting structure 2, respectively, and in particular the additional damping element 16 preferably extends on a considerable portion of the extension of the lower portion 2*a* of the unitary supporting structure 2.

Advantageously, this additional damping element 16 can basically extend wholly along one of the two horizontal dimensions of the lower portion 2*a*.

In a first alternative embodiment, the unitary supporting structure 2 can be bound to the ground by way of any suitable fastener, e.g. bolts or others.

Figure 5:
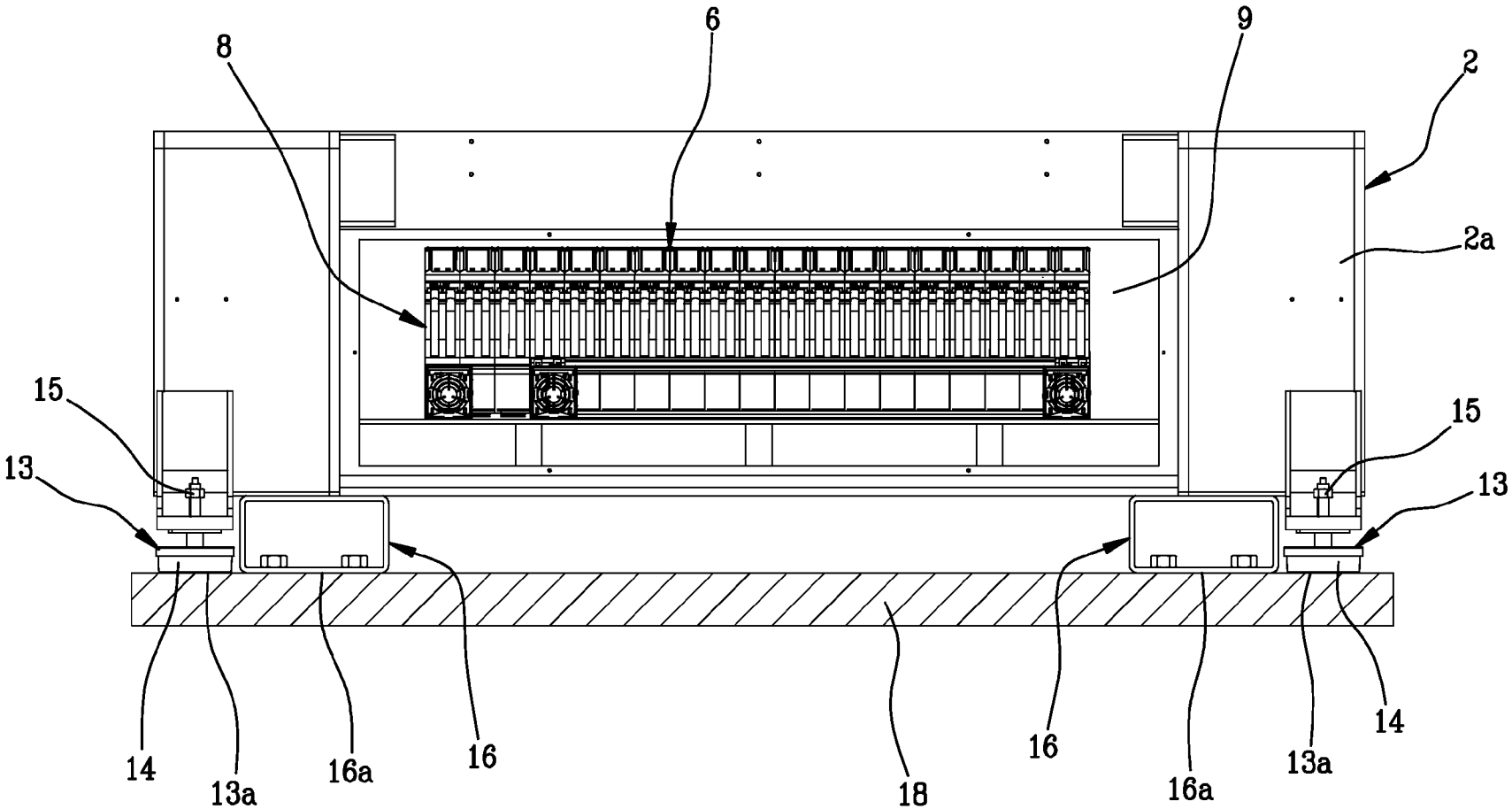
FIG. 5 is a view like the one in FIG. 2 of an alternative embodiment of the machine of FIG. 1.

In particular, in the embodiment shown in FIG. 5, the additional elements 16 extend up to the ground, have their resting surface 16*a* in contact with the ground, and are fastened to the ground by means of bolts for instance.

As an alternative, the additional elements 16 could extend up the ground and carry part of the machine load without being fastened to the ground.

In other alternative embodiments that are not shown in the accompanying figures, the additional elements 16 can be provided below with vibration damping devices, applied under the resting surface 16*a* for instance, which vibration damping devices can be in their turn in contact with the ground or at a certain distance 17 from the ground.

The invention thus conceived can be subject to many changes and variants, all which fall within the frame-work of the inventive idea. In practice, any material or size can be used depending on the various needs. Moreover, all details can be replaced with other technically equivalent elements.

The invention achieves important advantages. First of all, a warp-knitting machine according to the present invention has a compact, rational and little bulky structure. As a consequence, a machine according to the invention is easy to carry out, transport and install in the plant. Moreover, such a machine has an integrated and modular structure and enables an easy access for inspection and maintenance of the various electronic parts. Furthermore, a machine according to the invention is highly reliable during operation and reduces maintenance needs and costs with respect to known machines. Moreover, the configuration of the machine according to the invention significantly reduces the risk of faults during the mounting step of the machine and the risk of damages to the machine during use, since the machine structure is unique and compact, without outer connections subject to damages. Eventually, it should be pointed out that a warp-knitting machine according to the invention is easy to carry out and has short times and low costs for its implementation, transport and installation.

The invention claimed is:

1. A warp-knitting machine comprising:

a unitary supporting structure, at least one needle bed mounted on said unitary supporting structure, at least one thread-guide bar for feeding yarn to said needle bed, mounted on said unitary supporting structure, a yarn feeding device for feeding yarn to said thread-guide bar and to said needle bed; and electric and electronic devices for the operation of said warp-knitting machine, said electric and electronic devices comprising at least main electronic devices for operation of the warp-knitting machine, said main electronic devices comprising at least one or more of the following: (a) power electronic devices for piloting motors of the machine; (b) servodrives for piloting motors of the machine; and (c) electronic processing devices of the machine; said main electronic devices being fastened to said unitary supporting structure.

2. The machine according to claim 1, wherein said main electronic devices for operation of the warp-knitting machine are mounted into said unitary supporting structure.

3. The machine according to claim 2, wherein said main electronic devices for operation of the warp-knitting machine are mounted inside at least one housing compartment located on a lower portion of said unitary supporting structure, at a lower height than said needle bed and said thread-guide bar.

4. The machine according to claim 3, wherein said housing compartment is located on a lower portion of said unitary supporting structure and arranged below said needle bed and said thread-guide bar.

5. The machine according to claim 1, wherein said electric and electronic devices for operation of said warp-knitting machine, including connecting cables for parts of the machine, are all fastened wholly to said unitary supporting structure.

6. The machine according to claim 1, wherein said electric and electronic devices for operation of said warp-knitting machine, including connecting cables for parts of the machine, are integrated and mounted into said unitary supporting structure.

7. The machine according to claim 1, wherein said unitary supporting structure is according to one or more of the following: (a) it is a unique and independent structure; (b) it consists of a plurality of parts integrally connected to one another.

8. The machine according to claim 1, wherein said electric and electronic devices further comprise user interface electronic devices connected to said main electronic devices and fastened to said unitary supporting structure on one or more of the following: (a) a middle portion of said unitary supporting structures; (b) a side portion of said unitary supporting structure; said middle portion and side portion being each according to one or more of the following: (a) arranged above a lower portion; (b) arranged at a higher height than a lower portion.

9. The machine according to claim 1, wherein said electric and electronic devices further comprise secondary electronic devices for controlling mechanical parts of the warp-knitting machine, connected to and controlled by said main electronic devices and fastened to said unitary supporting structure on one or more of the following: (a) a middle portion of said unitary supporting structure; (b) a side portion of said unitary supporting structure; said middle portion and side portion being each according to one or more of the following: (a) arranged above a lower portion; (b) arranged at a higher height than a lower portion.

10. The machine according to claim 1, wherein said unitary supporting structure further comprises a plurality of feet for resting onto the ground apt to prop the machine, and further at least one additional damping element mounted below a lower portion of said unitary supporting structure and provided with a resting surface, said resting surface being configured so as to be at a predefined distance from the ground, with the machine still, and so as to get in contact with the ground during at least an operating condition of the machine, for damping vibrations thereof.

11. The machine according to claim 10, wherein said feet are provided with a resting surface for resting on the ground, and said resting surface of said additional damping element is configured so as to be, with the machine still, at a greater distance from the resting surface of said feet, and so as to lower at least up to the height of the resting surface of said feet during at least an operating condition of the machine.

12. The machine according to claim 10, wherein the distance between said resting surface of said additional damping element and the height of the resting surface on the ground of said feet, with the machine still, is smaller than the amplitude of the vibrations transmitted to said resting surface during at least an operating condition of the warp-knitting machine.

13. The machine according to claim 10, wherein the distance between said resting surface of said additional damping element and the height of the resting surface on the ground of said feet, with the machine still, is in the range of 1 to 5 mm.

14. The machine according to claim 10, comprising a plurality of said additional damping elements.

15. The machine according to claim 1, comprising a plurality of feet for resting onto the ground apt to prop the machine, which feet are provided with vibration damping devices.

16. The machine according to claim 15, wherein said feet are height adjustable so as to vary the height off the ground of the unitary supporting structure and of the warp-knitting machine and/or the distance from the ground of said resting surface.

17. The machine according to claim 1, comprising a plurality of additional damping elements having a lower resting surface resting onto the ground.

18. The machine according to claim 10, wherein said additional damping elements are provided with vibration damping devices fastened to said resting surface.

19. The machine according to claim 1, wherein said unitary supporting structure is bound to the ground by way of a fastener.

20. The machine according to claim 1, and according to one or more of the following: (a) at least part of said electric and electronic devices for operation of said warp-knitting machine is fastened to said unitary supporting structure by means of vibration damping elements placed in between them; (b) at least part of said main electronic devices for the operation of the warp-knitting machine is fastened to said unitary supporting structure by means of vibration damping elements placed in between them; (c) at least part of said secondary electronic devices for the control of the mechanical parts of the warp-knitting machine is fastened to said unitary supporting structure by means of vibration damping elements placed in between them.

* * * * *